US011352992B2

(12) United States Patent
Hardouin et al.

(10) Patent No.: US 11,352,992 B2
(45) Date of Patent: Jun. 7, 2022

(54) FUEL INJECTOR

(71) Applicant: DELPHI TECHNOLOGIES IP LIMITED, St. Michael (BB)

(72) Inventors: Ghislain Hardouin, Chailles (FR); Fabrizio A. Bonfigli, Mont pres Chambord (FR); Allan R. Wells, North Chili, NY (US)

(73) Assignee: DELPHI TECHNOLOGIES IP LIMITED, St. Michael (BB)

( * ) Notice: Subject to any disclaimer, the term of this patent is extended or adjusted under 35 U.S.C. 154(b) by 17 days.

(21) Appl. No.: 16/788,838

(22) Filed: Feb. 12, 2020

(65) Prior Publication Data

US 2021/0246859 A1 Aug. 12, 2021

(51) Int. Cl.
*F02M 55/00* (2006.01)
*F02M 63/00* (2006.01)

(52) U.S. Cl.
CPC ..... *F02M 55/004* (2013.01); *F02M 63/0015* (2013.01); *F02M 63/0036* (2013.01)

(58) Field of Classification Search
CPC ..... F02M 55/004; F02M 63/0015; F02M 63/0036
USPC ..... 239/584
See application file for complete search history.

(56) References Cited

U.S. PATENT DOCUMENTS 1,834,061 A * 12/1931 Joachim ..... F02M 45/086 239/410
2,374,614 A * 4/1945 Nichols ..... F02M 61/20 123/446
3,004,720 A * 10/1961 Steinke ..... F02D 41/32 239/585.5
3,241,768 A * 3/1966 Croft ..... F02M 61/162 239/124
4,206,635 A * 6/1980 Teerman ..... F02M 65/005 73/114.49
4,327,694 A * 5/1982 Henson ..... F02D 1/10 123/500
4,445,713 A * 5/1984 Bruning ..... F02M 55/005 123/198 D
5,566,660 A * 10/1996 Camplin ..... F02M 45/06 123/299
6,808,133 B1 * 10/2004 Stier ..... F02M 61/166 239/585.1

(Continued)

FOREIGN PATENT DOCUMENTS

DE 3844371 A1 * 7/1990 ..... F02M 55/005
DE 10257953 A1 * 7/2004 ..... F02M 55/005

*Primary Examiner* — Mahmoud Gimie
(74) *Attorney, Agent, or Firm* — Joshua M. Haines

(57) ABSTRACT

A fuel injector includes an upper housing having an outer peripheral surface; a nozzle tip with a nozzle opening which serves as an outlet to fuel from the fuel injector; and a valve needle which is selectively moveable between a first position which prevents fuel flow and a second position which permits fuel flow. The fuel injector also includes an inlet sleeve which includes an inner peripheral surface which circumferentially surrounds, and mates with, the outer peripheral surface of the upper housing. The inlet sleeve is fixed to the upper housing, thereby preventing relative movement between the inlet sleeve and the upper housing. The inlet sleeve includes external threads which are configured to mate with complementary internal threads of a nut which secures a fuel supply conduit to the upper housing.

20 Claims, 6 Drawing Sheets

(56) References Cited

U.S. PATENT DOCUMENTS

| | | | |
|---|---|---|---|
| 8,196,967 | B2 | 6/2012 | Seifert et al. |
| 2008/0042434 | A1 | 2/2008 | Kenny |
| 2011/0315795 | A1 | 12/2011 | Mieney et al. |
| 2017/0350358 | A1 | 12/2017 | Bayer et al. |

* cited by examiner

FUEL INJECTOR

TECHNICAL FIELD OF INVENTION

The present disclosure relates to a fuel injector for injecting fuel into an internal combustion engine, and more particularly to a fuel injector which includes an inlet sleeve for attaching the fuel injector to a fuel supply conduit.

BACKGROUND OF INVENTION

Fuel injection systems that deliver fuel to fuel consuming devices, for example internal combustion engines, have been known for many years. In modern internal combustion engines, it is increasingly common to provide fuel injectors which inject fuel, for example gasoline, directly into combustion chambers of the internal combustion engine. These internal combustion engines commonly include multiple combustion chambers, and consequently, each combustion chamber is provided with a respective fuel injector to inject fuel therein. A common conduit, typically referred to as a fuel rail, includes an inlet which receives fuel from a fuel source, such as one or more fuel pumps, and also includes a plurality of outlets, each of which is connected to a respective one of the fuel injectors.

Fuel injectors in gasoline fuel injection systems currently are predominantly sealed to a fuel supply conduit, which supplies fuel to the fuel injector from the fuel rail, by an O-ring which is made of an elastomeric material. One such arrangement which uses an elastomeric O-ring is shown in United States Patent Application Publication No. US 2017/0350358 to Bayer et al. While O-rings may be adequate for sealing in current systems which operate below 35 MPa, in order to meet more stringent emissions requirements and fuel economy demands, gasoline fuel injection systems are expected to exceed 35 MPa and will likely exceed 50 MPa. Sealing with an elastomeric O-ring in systems using these elevated pressures may be difficult. Consequently, metal-to-metal sealing arrangements are being explored to provide robust sealing between the fuel injector and the fuel supply conduit. Such metal-to-metal connections may include a nut having internal threads being engaged with complementary external threads provided on an inlet conduit of the fuel injector. When the nut is tightened, complementary mating surfaces of the fuel supply conduit and of the fuel injector are pressed together to form a fluid-tight connection. While this may not be complex in principle, the addition of external threads to the inlet conduit of the fuel injector may be problematic based on the overall design of the existing fuel injector. More specifically, many fuel injectors include a solenoid assembly which is used to impart motion on a valve needle within the fuel injector. The valve needle is moved into and out of contact with a valve needle seat in order to prevent and permit, respectively, flow of fuel out of the fuel injector. During manufacture of the fuel injector, the solenoid assembly may need to be slid over the inlet conduit. However, the addition of the external threads, which must be large enough to accommodate the fuel supply conduit of sufficient size to provide necessary fuel flow rates and pressure pulsation damping characteristics, may be too large to allow the solenoid assembly be slid thereover. Simply increasing the size of the solenoid assembly may not be possible because merely increasing the size of the solenoid assembly will affect other aspects of the resulting magnetic circuit. As a result, a complete redesign of the fuel injector may be required to accommodate the addition of the external threads on the inlet conduit. Such a redesign would be costly and time intensive and may result in a fuel injector that is larger than desired. Furthermore, current fuel injectors must be calibrated during the manufacturing process to ensure desired flow characteristics are achieved. This calibration involves connecting the inlet conduit to a calibration fixture which supplies a calibration fluid to the fuel injector, measuring the flow characteristics, and adjusting internal components to achieve the desired flow characteristics. Changing the sealing arrangement of the fuel injector would also require a change in manufacturing equipment used in the calibration process which would also be costly to implement.

What is needed is a fuel injector which minimizes or eliminates one or more of the shortcomings set forth above. More specifically, a solution is needed to minimize the impact on design of the fuel injector and associated manufacturing equipment while providing a robust sealing interface between the fuel injector and the fuel supply conduit at ever-increasing fuel pressures supplied to the fuel injector.

SUMMARY OF THE INVENTION

Briefly described, a fuel injector is provided for supplying fuel to a fuel consuming device from a fuel supply conduit. The fuel injector includes an upper housing which extends along an axis and which serves as an inlet of fuel to the fuel injector, the upper housing having an outer peripheral surface which extends along the axis; a nozzle tip with a nozzle opening which serves as an outlet to fuel from the fuel injector; a valve needle which is selectively moveable between 1) a first position which prevents flow of fuel from the upper housing through the nozzle opening and 2) a second position which permits flow of fuel from the upper housing through the nozzle opening; and an inlet sleeve which includes an inner peripheral surface which circumferentially surrounds, and mates with, the outer peripheral surface of the upper housing, the inlet sleeve being fixed to the upper housing, thereby preventing relative movement between the inlet sleeve and the upper housing, and the inlet sleeve including external threads which are configured to mate with complementary internal threads of a nut which secures the fuel supply conduit to the upper housing. The fuel injector as describe herein, which includes the inlet sleeve, allows for a robust sealing interface with the fuel supply conduit which does not rely on an elastomeric O-ring to seal the high-pressure fuel. Furthermore, by using the inlet sleeve, existing fuel injector designs may be utilized, thereby eliminating the need to complete a more substantial redesign of the fuel injector which is otherwise suitable for injecting fuel under increased pressures. Also furthermore, the use of the inlet sleeve allows existing manufacturing equipment to be used in operations such as calibration of fuel injector. As a result, capital expenditures are minimized to provide a metal-to-metal sealing interface between the fuel injector and the fuel supply conduit.

BRIEF DESCRIPTION OF DRAWINGS

This invention will be further described with reference to the accompanying drawings in which.

DETAILED DESCRIPTION OF INVENTION

Figure 1:
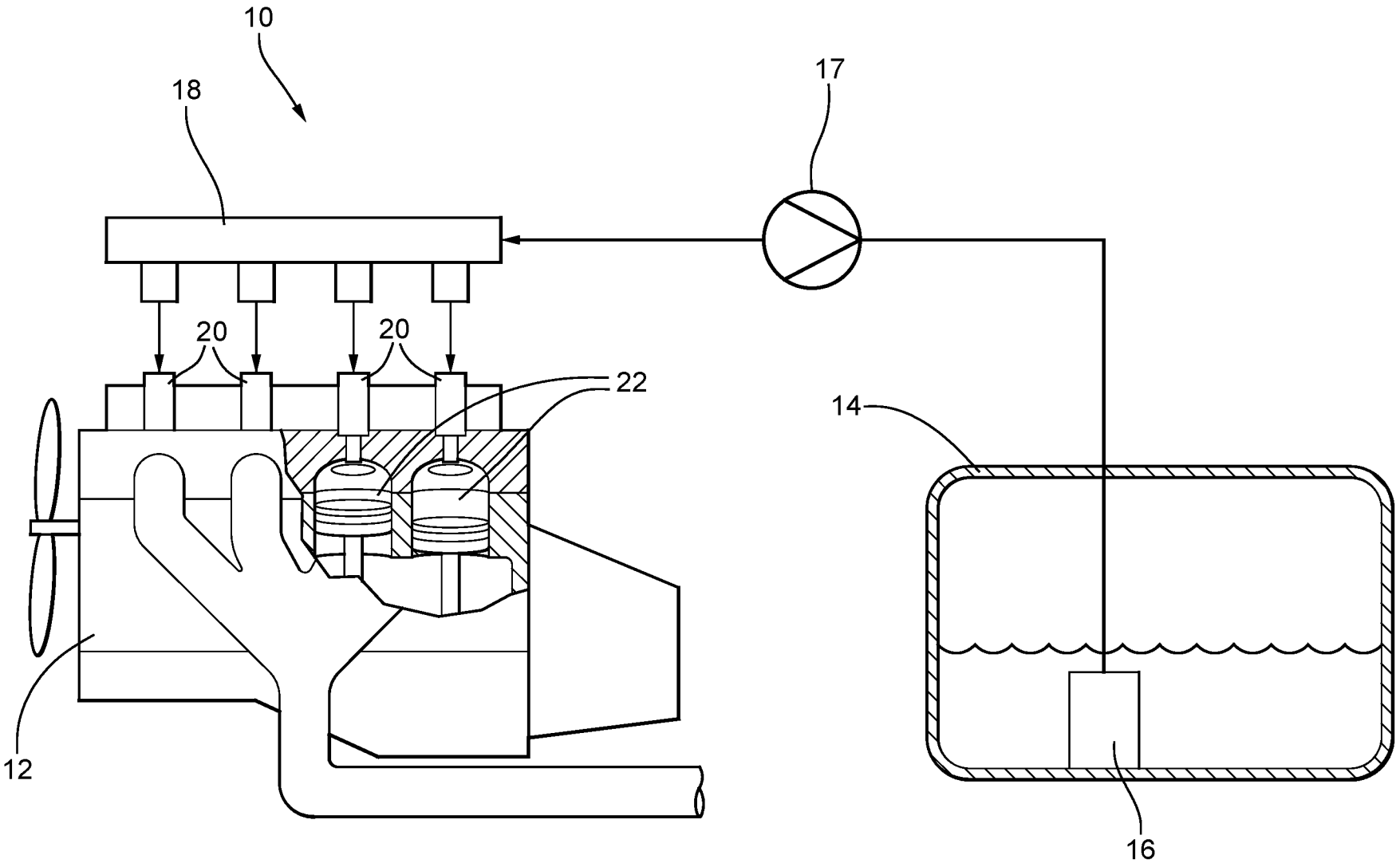
FIG. 1 is a schematic view of a fuel system and internal combustion engine in accordance with the present disclosure.
Figure 2:
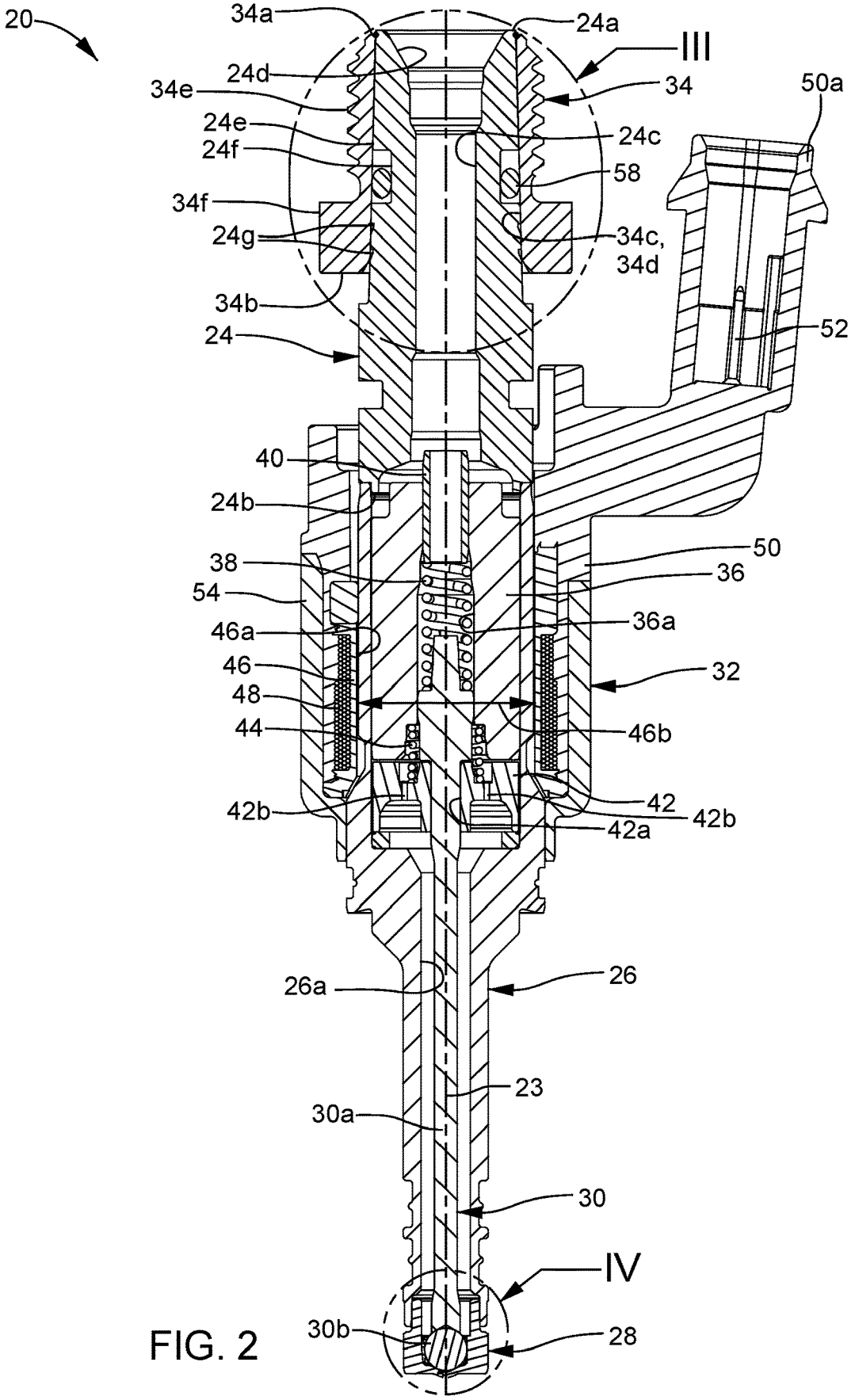
FIG. 2 is an axial cross-sectional view of a fuel injector in accordance with the present disclosure.
Figure 3:
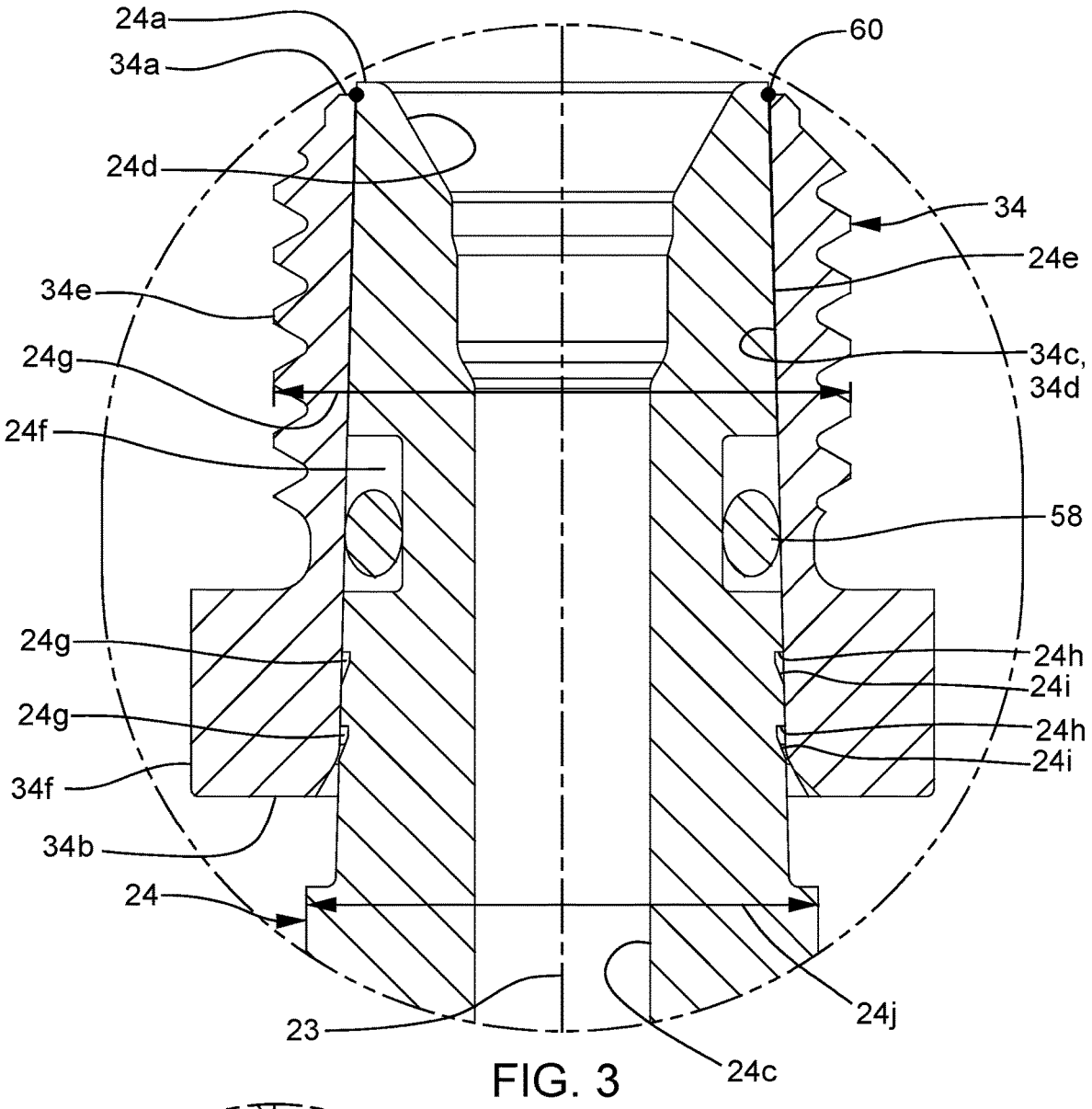
FIG. 3 is an enlargement of circle III of FIG. 2.
Figure 4:
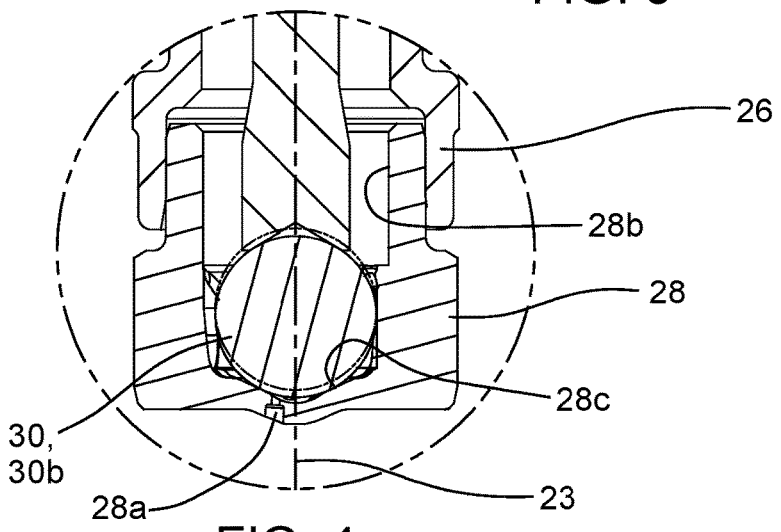
FIG. 4 is an enlargement of circle IV of FIG. 2.
Figure 5:
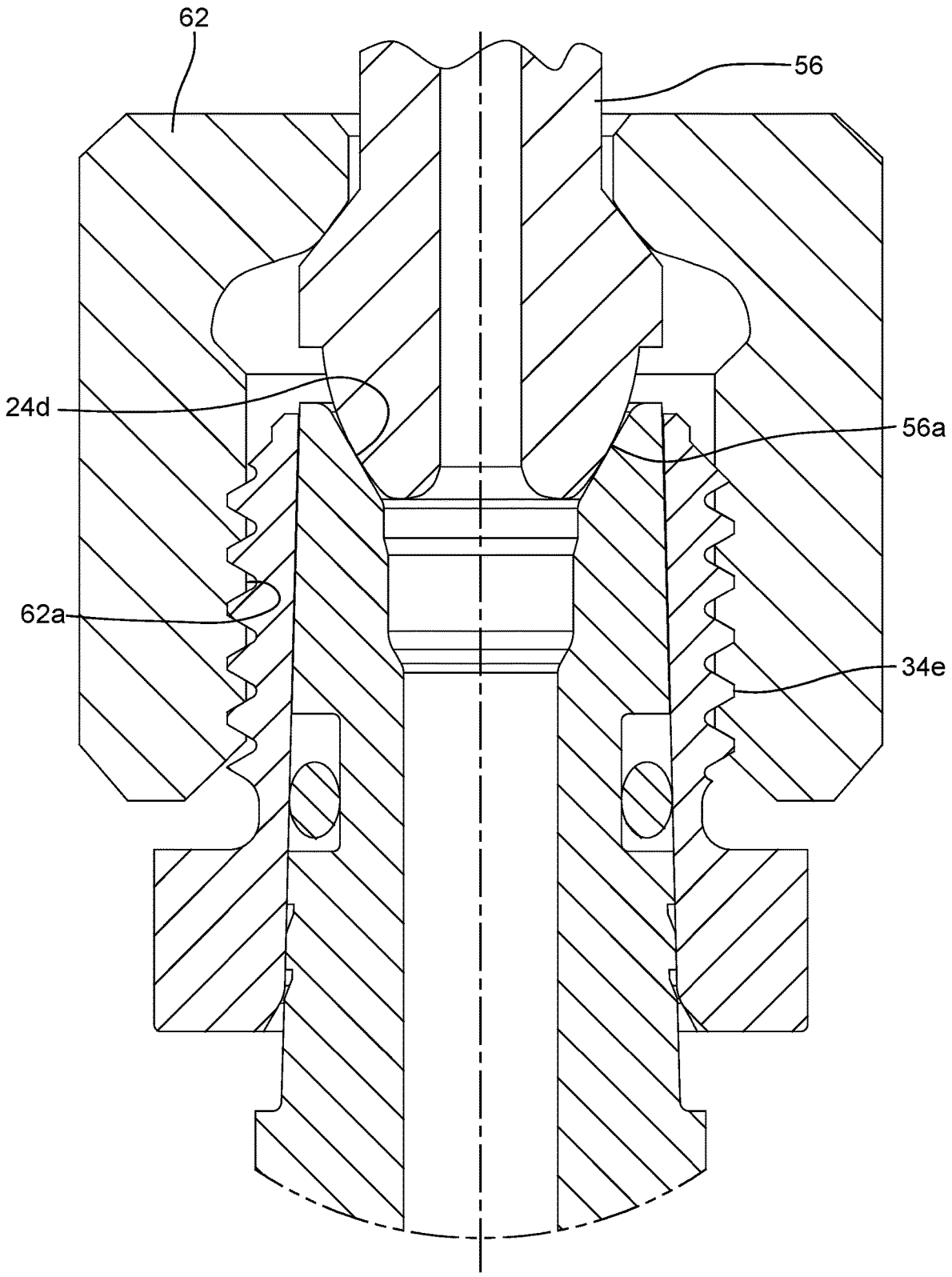
FIG. 5 is the view of FIG. 3, now shown with a fuel supply conduit attached to the fuel injector.
Figure 6:
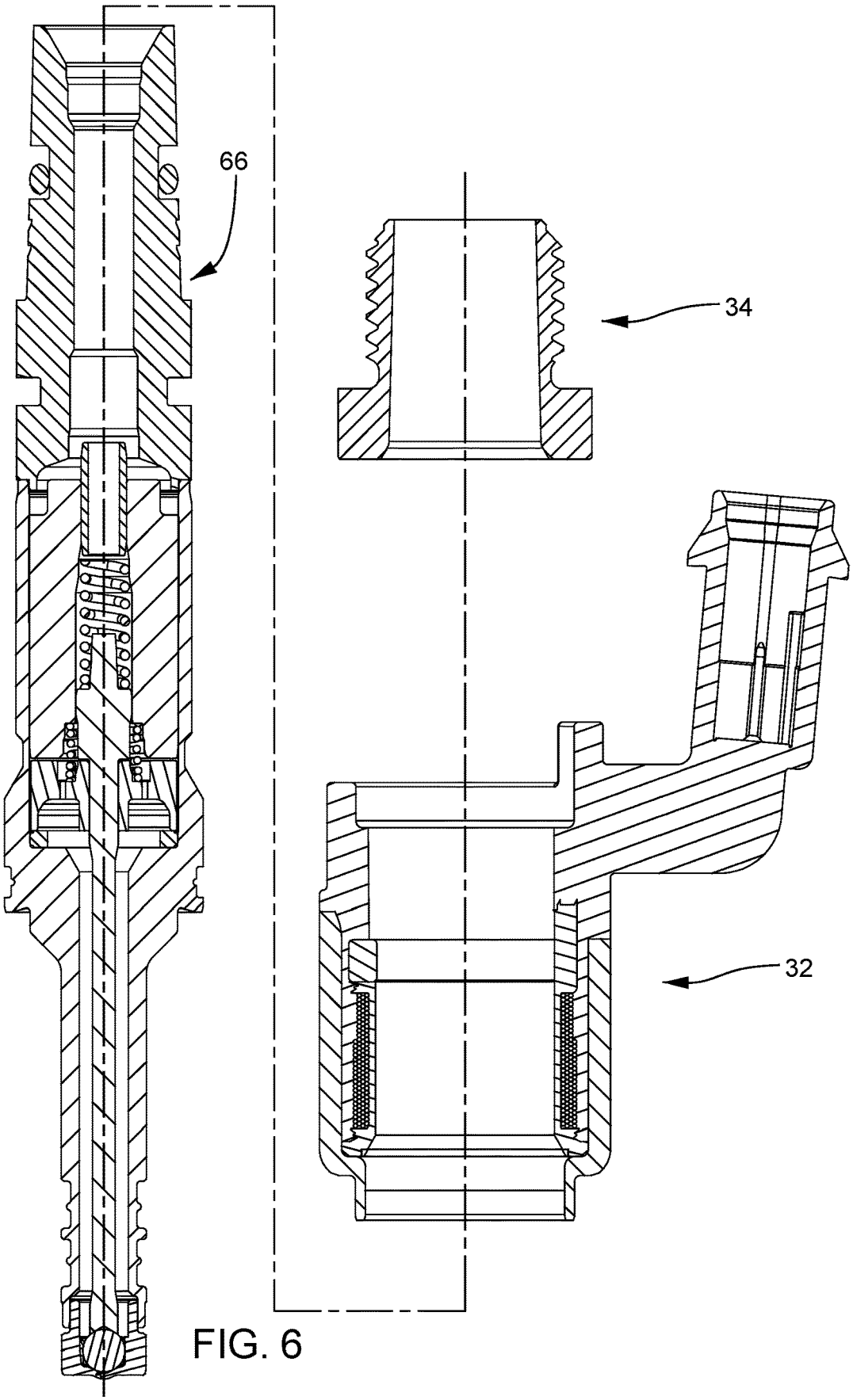
FIG. 6 is the fuel injector of FIG. 2 shown exploded as a first subassembly, a solenoid assembly, and an inlet sleeve.

Referring initially to FIG. 1, a fuel system 10 is shown in simplified schematic form for supplying fuel to a fuel consuming device, for example an internal combustion engine 12, by way of non-limiting example only, for a motor vehicle. Fuel system 10 includes a fuel tank 14 for storing a volume of fuel, a low-pressure fuel pump 16 which may be located within fuel tank 14 as shown, a high-pressure fuel pump 17 which receives fuel from low-pressure fuel pump 16, a fuel rail 18 attached to internal combustion engine 12 and in fluid communication with high-pressure fuel pump 17, and a plurality of fuel injectors 20 in fluid communication with fuel rail 18. In operation, low-pressure fuel pump 16 draws fuel from fuel tank 14 and pumps the fuel to high-pressure fuel pump 17 under relatively low pressure, for example about 500 kPa. High-pressure fuel pump 17, which may be a piston pump operated by a cam of internal combustion engine 12, further pressurizes the fuel and supplies the fuel to fuel rail 18 under relatively high pressure, for example, above about 14 MPa and even reaching 35 MPa or higher. Each fuel injector 20 receives fuel from fuel rail 18 and injects the fuel into a respective combustion chamber 22 of internal combustion engine 12 for combustion of the fuel within combustion chambers 22.

Referring now to FIGS. 2-7, fuel injector 20 is shown in axial cross section. Fuel injector 20 extends along a fuel injector axis 23 and generally includes an upper housing 24 which serves as an inlet of fuel to fuel injector 20; a lower housing 26 which is terminated with a nozzle tip 28 having at least one nozzle opening 28*a* which serves as an outlet of fuel from fuel injector 20; a valve needle 30 which is selectively moveable between 1) a first position, shown most clearly in FIG. 4 in solid lines) which prevents flow of fuel from upper housing 24 through nozzle opening 28*a* and 2) a second position, shown most clearly in FIG. 4 in phantom lines, which permits flow of fuel from upper housing 24 through nozzle opening 28*a*; a solenoid assembly 32 which is used to move valve needle 30 between the first position and the second position; and an inlet sleeve 34 which circumferentially surrounds upper housing 24. The various elements of fuel injector 20 will be described in greater detail in the paragraphs that follow.

Lower housing 26 is made of metal, for example, stainless steel, and extends along fuel injector axis 23. Lower housing 26 includes a lower housing bore 26*a* extending axially therethrough such that lower housing 26 accommodates valve needle 30 therein and also serves as a portion of a fuel passage through which fuel flows through fuel injector 20. The end of lower housing 26 which is proximal to nozzle tip 28 may be enlarged and stepped as shown in order to receive a portion or nozzle tip 28 therein such that nozzle tip 28 is fixed to lower housing 26, by way of non-limiting example only, by one or more of interference fit and welding. Furthermore, the upper end of lower housing 26 which is proximal to upper housing 24 may be enlarged and stepped in order to receive a pole piece 36 which is part of a magnetic circuit which causes valve needle 30 to move between the first position and the second position as will be described in greater detail later. Pole piece 36 may be fixed to upper housing 24, by way of non-limiting example only, by interference fit, such that relative movement between pole piece 36 and upper housing 24 is prevented.

Nozzle tip 28 is made of metal, for example stainless steel, and includes a nozzle tip bore 28*b* extending thereinto along fuel injector axis 23 from the end of nozzle tip 28 that faces toward lower housing 26 such that one end of valve needle 30 extends thereinto. The bottom of nozzle tip bore 28*b* defines a valve seating surface 28*c* upon which valve needle 30 is seated in the first position and from which valve needle 30 is spaced apart in the second position. The one or more nozzle openings 28*a* extends from the bottom of nozzle tip bore 28*b* to the exterior surface of nozzle tip 28 such that discharge of fuel from nozzle openings 28*a* is prevented when valve needle 30 is seated with valve seating surface 28*c* and such that discharge of fuel from nozzle openings 28*a* is permitted when valve needle 30 is spaced apart from valve seating surface 28*c*.

Valve needle 30 may be a two-piece assembly as shown, namely an elongated valve stem 30*a* and a valve member 30*b* which may be a spherical ball, however, other shapes are also anticipated. Valve stem 30*a* and valve member 30*b* are fixed together, for example, by welding. Alternatively, valve needle 30 may be made of unitary construction as a single piece of material. The upper end of valve needle 30 extends into a pole piece bore 36*a* of pole piece 36 which extends axially therethrough. A portion of valve needle 30 which extends into pole piece bore 36*a* is guided by pole piece bore 36*a* such that axial movement of valve needle 30 is not restricted, however, radial movement of valve needle 30 is prohibited within an acceptable tolerance range. Furthermore, the portion of valve needle 30 that is guided by pole piece bore 36*a* may include flutes, grooves, or flats spaced around the periphery thereof in order to provide a path for fuel to flow therethrough, however, it should be noted that due to the location of the cross section of FIG. 2, the flutes, grooves, or flats are not visible. In addition to, or in the alternative, a flow path may be created by features such as flutes, grooves, or flats that may be located on the outer periphery of pole piece 36, thereby providing a flow path radially between pole piece 36 and lower housing 26.

Valve needle 30 may be biased to the first position, i.e. seated against valve seating surface 28*c* by a valve needle spring 38 which is located within pole piece bore 36*a*. One end of valve needle spring 38 is in contact with an upward-facing shoulder of valve needle 30 while the other end of valve needle spring 38 is in contact with a calibration tube 40 which is fixed to pole piece 36, for example by interference fit within pole piece bore 36*a*. The force of valve needle spring 38 acting on valve needle 30 is adjusted in the manufacturing process by the extent to which calibration tube 40 compresses valve needle spring 38. Consequently, flow characteristics through fuel injector 20 can be monitored and the extent to which calibration tube 40 is inserted can be adjusted to achieve desired flow characteristics.

An armature 42 is provided below pole piece 36 in lower housing bore 26*a* such that armature 42 is moveable axially therein. Armature 42 is made of a material which is attracted by a magnet and includes an armature bore 42*a* which extends therethrough along fuel injector axis 23 such that valve needle 30 passes therethrough in a close-sliding interface such that axial movement between valve needle 30 and armature 42 is permitted. Armature 42 is biased in a downward direction by an armature spring 44 such that one end of armature spring 44 is in contact with armature 42 and the other end of armature spring 44 is contact with pole piece 36.

When armature 42 is moved upward by solenoid assembly 32, as will be described in greater detail later, armature 42 initially moves without causing movement to valve needle 30. After armature 42 has moved sufficiently far, the upper end of armature 42 engages a shoulder of valve needle 30, thereby causing valve needle 30 to also move upward to the second position. While armature 42 has been illustrated herein as being moveable with respect to valve needle 30, it should be understood that armature 42 may alternatively be fixed directly to valve needle 30 such that armature 42 and valve needle 30 always move together. When armature 42 is fixed directly to valve needle 30, one of valve needle spring 38 and armature spring 44 may be omitted.

In addition to armature bore 42*a*, armature 42 includes one or more armature flow passages 42*b* extending axially therethrough such that armature flow passages 42*b* are space radially outward from armature bore 42*a*. Armature flow passages 42*b* provide a path for fuel to flow past armature 42.

Solenoid assembly 32 includes a bobbin 46 which is made of an electrically insulative material such that bobbin 46 includes a bobbin bore 46*a* which extends therethrough along fuel injector axis 23 and such that lower housing 26 passes through bobbin bore 46*a*. Bobbin bore 46*a* has a bobbin inside diameter 46*b* which represents the smallest inside diameter thereof which limits the size of an element that may pass through bobbin bore 46*a*.

Solenoid assembly 32 also includes a wire winding 48 which is wound about bobbin 46. At least a portion of wire winding 48 is located radially outward from pole piece 36 such that pole piece 36 is magnetized when an electric current is applied to wire winding 48, thereby causing armature 42 to be attracted to pole piece 36 and also thereby moving armature 42 and valve needle 30 upward.

Solenoid assembly 32 also includes an overmold 50 which is made of an electrically insulative polymer material. Overmold 50 encapsulates wire winding 48 and forms an electrical connector 50*a* within which is located a pair of terminals 52, only one of which is visible in the drawings, which are connected to respective ends of wire winding 48. Electrical connector 50*a* is configured to mate with a complementary electrical connector (not shown) to provide an electrical interface with terminals 52 in order to supply an electric current thereto.

Solenoid assembly 32 also includes an outer housing 54 which is made of a metal material and which circumferentially surrounds a portion of overmold 50. The lower end of outer housing 54, i.e. the end of outer housing 54 which is proximal to nozzle tip 28, is reduced in size and engages the outer periphery of lower housing 26 and is fixed thereto, for example by welding.

Upper housing 24, which serves as an inlet of fuel to fuel injector 20 as mentioned previously, extends along fuel injector axis 23 from a top end 24*a* which is distal from lower housing 26 to a bottom end 24*b* which is proximal to lower housing 26. Bottom end 24*b* may extend into lower housing bore 26*a* such that lower housing 26 engages a shoulder of upper housing 24. Upper housing 24 is made of metal, for example, stainless steel and is fixed to lower housing 26 by one or more of interference fit and welding.

Upper housing 24 includes an upper housing bore 24*c* extending axially therethrough from top end 24*a* to bottom end 24*b* such that upper housing bore 24*c* serves as a portion of the fuel passage through which fuel flows through fuel injector 20. Upper housing bore 24*c* includes an inlet seating surface 24*d* which is used to mate with a fuel supply conduit 56. As illustrated herein, inlet seating surface 24*d* may preferably be frustoconical to allow angular misalignment between fuel injector 20 and fuel supply conduit 56 while maintaining a fluid-tight connection. Upper housing 24 also includes an outer peripheral surface 24*e* which extends along fuel injector axis 23. Outer peripheral surface 24*e* is preferably frustoconical in shape which forms a shallow angle relative to fuel injector axis 23. As used herein, the shallow angle is in a range of 2° and 5°, however, the angle is preferably 3°.

Upper housing 24 also includes a sealing ring groove 24*f* which extends radially into outer peripheral surface 24*e* such that sealing ring groove 24*f* is annular in shape and such that an elastomeric O-ring 58 is located therein. Sealing ring groove 24*f* therefore divides outer peripheral surface 24*e* into separate sections. In addition to sealing ring groove 24*f*, upper housing 24 may also include one or more retention grooves 24*g* extending radially into outer peripheral surface 24*e* such that retention grooves 24*g* are each annular in shape. Retention grooves 24*g* each include an upper shoulder 24*h* which is substantially perpendicular to fuel injector axis 23, i.e. within ±5°, and which intersects with outer peripheral surface 24*e*. Retention grooves 24*g* each also include a lower lead-in surface 24*i* which is inclined relative to fuel injector axis 23 in a range of about 10° to about 45° such that lower lead-in surface 24*i* diverges away from fuel injector axis 23 in a direction away from upper shoulder 24*h* and which intersects with outer peripheral surface 24*e*. The purpose of retention grooves 24*g* will be made more clear later.

Upper housing 24 has a maximum external diameter 24*j*, i.e. the largest external portion along fuel injector axis 23, such that maximum external diameter 24*j* is less than or equal to bobbin inside diameter 46*b*. This relationship between maximum external diameter 24*j* and bobbin inside diameter 46*b* allows solenoid assembly 32 to be assembled over upper housing 24.

Inlet sleeve 34 extends along fuel injector axis 23 from an upper-most end 34*a* which is distal from nozzle tip 28 to a lower-most end 34*b* which is proximal to nozzle tip 28. Inlet sleeve 34 is made of metal, for example stainless steel, and includes an inlet sleeve bore 34*c* extending axially therethrough from upper-most end 34*a* to lower-most end 34*b*. Inlet sleeve bore 34*c* defines an inner peripheral surface 34*d* of inlet sleeve 34 which circumferentially surrounds, and mates with outer peripheral surface 24*e* of upper housing 24. Inner peripheral surface 34*d* is frustoconical in shape and complementary to outer peripheral surface 24*e* of upper housing 24. As used herein, complementary means±0.5° departure from the angle of outer peripheral surface 24*e* of upper housing 24 relative to fuel injector axis 23. O-ring 58 is circumferentially compressed by upper housing 24 and by inlet sleeve 34, however, it should be noted that O-ring 58 provides no sealing function after inlet sleeve 34 is applied to upper housing 24, i.e. O-ring 58 does not provide fluid sealing between fuel supply conduit 56 and fuel injector 20. Upper housing 24 extends through inlet sleeve 34 such that upper housing 24 extends beyond upper-most end 34*a* of inlet sleeve 34 in a direction away from nozzle tip 28. A weld 60 is located at an intersection of upper-most end 34*a* of inlet sleeve 34 and a portion of upper housing 24 which extends beyond upper-most end 34*a* of inlet sleeve 34 in the direction away from nozzle tip 28, thereby fixing inlet sleeve 34 to upper housing 24 and preventing relative movement between inlet sleeve 34 and upper housing 24. In addition to, or in the alternative, a weld could be located at an intersection of lower-most end 34*b* of inlet sleeve 34 and a portion of upper housing 24 which extends beyond lower-most end 34*b* in the direction toward nozzle tip 28.

Inlet sleeve 34 also includes external threads 34*e* which are configured to mate with complementary internal threads 62*a* of a nut 62 which secures fuel supply conduit 56 to upper housing 24. More specifically, when nut 62 is tightened to inlet sleeve 34, i.e. by rotation of nut 62 relative to upper housing 24, a fuel supply conduit seating surface 56*a* of fuel supply conduit 56 is sealingly pressed against inlet seating surface 24*d* of upper housing 24, thereby preventing fuel leakage in use between the interface of fuel supply conduit 56 and upper housing 24. External threads 34*e* have a major diameter 34*g* which is greater than bobbin inside diameter 46*b*. A means for preventing rotation 34*f* of fuel injector 20 when nut 62 is tightened to upper housing 24 is provided such that means for preventing rotation 34*f* may include opposing flats, a hexagonal shape, or any other shape that is configured to interface with a tool, such as a wrench (not shown), to provide a holding force to prevent rotation of fuel injector 20 during tightening of nut 62. Means for preventing rotation 34*f* is located axially between external threads 34*e* and nozzle tip 28.

Figure 7:
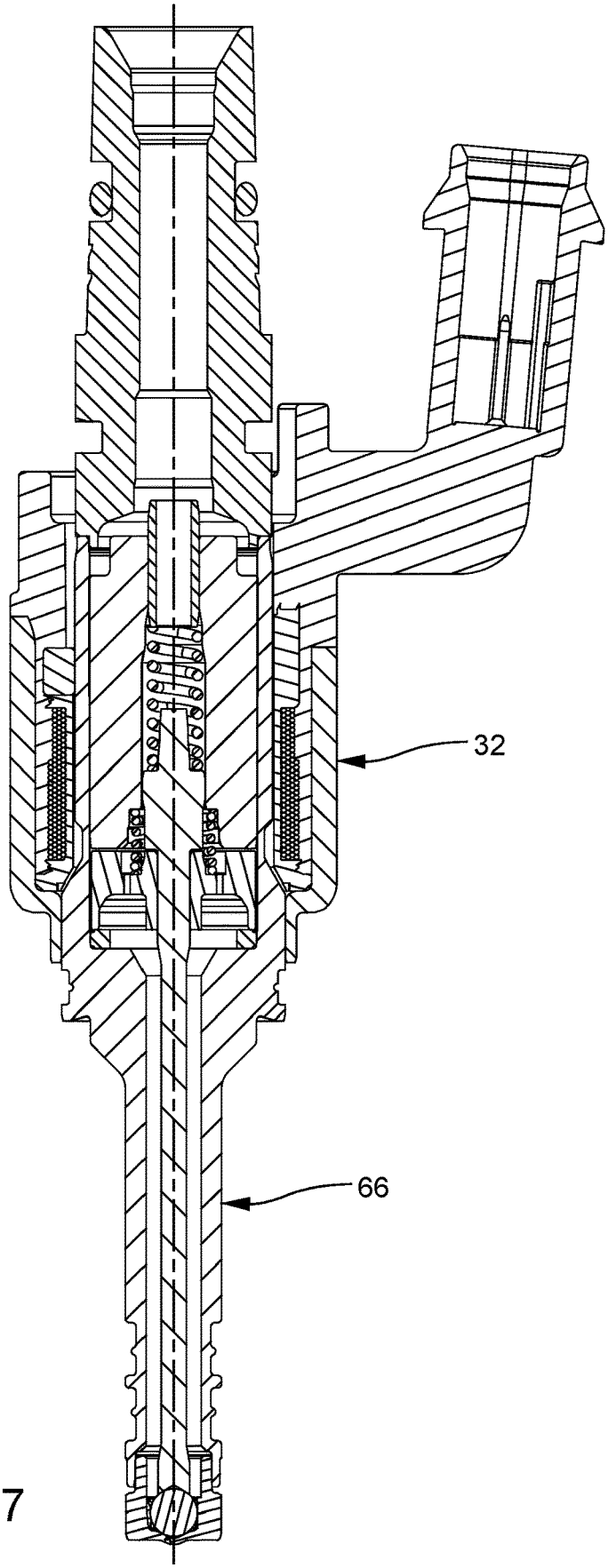
FIG. 7 shows the solenoid assembly and the first subassembly of FIG. 6 assembled to each other.

During manufacture of fuel injector 20, a first subassembly 66 comprising upper housing 24, lower housing 26, nozzle tip 28, valve needle 30, pole piece 36, valve needle spring 38, armature 42, and armature spring 44 is assembled independently of solenoid assembly 32. Subsequently, solenoid assembly 32 is assembled to first subassembly 66, as shown in FIG. 7, by sliding solenoid assembly 32 over first subassembly 66 from top end 24*a* and outer housing 54 is welded to lower housing 26. Next, the combination of first subassembly 66 and solenoid assembly 32 is calibrated to provide desired flow characteristics. This is accomplished by inserting upper housing 24 into a calibration fixture (not shown) which provides a calibration fluid such that O-ring 58 is used to provide a fluid-tight seal with the calibration fixture. Valve needle 30 is moved between the first position and the second position by starting and stopping an electric current to wire winding 48 while the test fluid expelled from nozzle openings 28*a* is measured. The axial position of calibration tube 40 is adjusted to achieve the desired flow characteristic from nozzle openings 28*a*. After calibration has taken place, upper housing 24 is removed from the calibration fixture and a filter (not shown) may be inserted into upper housing bore 24*c*. Next, inlet sleeve 34 is positioned on upper housing 24 and fixed thereto by weld 60. It should be noted that the shallow angle of outer peripheral surface 24*e* of upper housing 24 mating in complementary fashion with inner peripheral surface 34*d* of inlet sleeve 34 may assist in holding upper housing 24 together with inlet sleeve 34 while weld 60 is being formed. Furthermore, retention grooves 24*g* may additionally assist in holding upper housing 24 together with inlet sleeve 34 while weld 60 is being formed due to the sharp corner at upper shoulder 24*h* which tends to bite into inlet sleeve 34 and inhibit removal of inlet sleeve 34 due to upper shoulder 24*h* intersecting with inner peripheral surface 34*d*. However, even though lower lead-in surface 24*i* intersects with inner peripheral surface 34*d*, the inclined nature of lower lead-in surface 24*i* allows for easy assembly of inlet sleeve 34 to upper housing 24. It should also be noted that while O-ring 58 is illustrated as remaining in sealing ring groove 24*f* after inlet sleeve 34 is assembled, since O-ring 58 only provides sealing during the calibration process, O-ring 58 may alternatively be removed after the calibration process.

As should now be clear, fuel injector 20, which includes inlet sleeve 34, allows for a robust sealing interface with fuel supply conduit 56 which does not rely on an elastomeric O-ring to seal the high-pressure fuel. Furthermore, by using inlet sleeve 34, existing fuel injector designs may be utilized, thereby eliminating the need to complete a more substantial redesign of the fuel injector which is otherwise suitable for injecting fuel under increased pressures. Also furthermore, the use of inlet sleeve 34 allows existing manufacturing equipment to be used in operations such as calibration of fuel injector 20. As a result, capital expenditures are minimized to provide a metal-to-metal sealing interface between the fuel injector 20 and fuel supply conduit 56. An added benefit is that the inlet sleeve can be made with different thread sizes to accommodate different sizes of fuel supply conduits. As a result, fuel injector 20 can be made the same for different applications with the exception of inlet sleeve 34 being provided with the appropriate size threads to be complementary to the nut which is needed to interface with the particular size fuel supply conduit that will be mated to fuel injector 20. For example, one inlet sleeve 34 could incorporate external threads 34*e* of size M12 while another inlet sleeve 34 could incorporate external threads 34*e* of size M17 or even larger. This would allow commonality of all other components of fuel injector 20 while accommodating different sizes of fuel supply conduit 56.

While the invention has been described by reference to various specific embodiments, it should be understood that numerous changes may be made within the spirit and scope of the inventive concepts described. Accordingly, it is intended that the invention not be limited to the described embodiments, but rather only to the extent set forth in the claims that follow.

We claim:

1. A fuel injector for supplying fuel to a fuel consuming device from a fuel supply conduit, said fuel injector comprising:

an upper housing which extends along an axis and which serves as an inlet of fuel to said fuel injector, said upper housing having an outer peripheral surface which extends along said axis;

a nozzle tip with a nozzle opening which serves as an outlet to fuel from said fuel injector;

a valve needle which is selectively moveable between 1) a first position which prevents flow of fuel from said upper housing through said nozzle opening and 2) a second position which permits flow of fuel from said upper housing through said nozzle opening; and an inlet sleeve which includes an inner peripheral surface which circumferentially surrounds, and mates with, said outer peripheral surface of said upper housing, said inlet sleeve being fixed to said upper housing, thereby preventing relative movement between said inlet sleeve and said upper housing, and said inlet sleeve including external threads which are configured to mate with complementary internal threads of a nut which secures said fuel supply conduit to said upper housing.

2. A fuel injector as in claim 1, wherein:

said outer peripheral surface of said upper housing is frustoconical; and said inner peripheral surface of said inlet sleeve is frustoconical and complementary to said outer peripheral surface of said upper housing.

3. A fuel injector as in claim 1, wherein:

said outer peripheral surface of said upper housing includes a sealing ring groove extending thereinto such that said sealing ring groove is annular in shape; and said fuel injector further comprises and elastomeric O-ring within said sealing ring groove such that said elastomeric O-ring is circumferentially compressed by said upper housing and by said inlet sleeve.

4. A fuel injector as in claim 3, wherein said elastomeric O-ring does not provide fluid sealing between fuel said fuel supply conduit and said fuel injector.

5. A fuel injector as in claim 3, wherein said outer peripheral surface of said upper housing includes a retention groove extending thereinto such that said retention groove is annular in shape and located axially between said sealing ring groove and said nozzle tip.

6. A fuel injector as in claim 5, wherein said retention groove includes:

an upper shoulder which is substantially perpendicular to said axis and which intersects with said outer peripheral surface and said inner peripheral surface; and a lower lead-in surface between located axially between said upper shoulder and said nozzle tip, said lower lead-in surface being inclined relative to said axis in range of about 10° to about 45° such that said lower lead-in surface diverges away from said axis in a direction away from said upper shoulder and said lower lead-in surface intersecting with said outer peripheral surface and said inner peripheral surface.

7. A fuel injector as in claim 1, wherein said fuel injector further comprises:

a lower housing having an upper end which is proximal to said upper housing and a lower end which is proximal to said nozzle opening, said valve needle being located within said lower housing; and a solenoid assembly comprising 1) a bobbin having a bobbin inside diameter and 2) a wire winding which is wound abound said bobbin, wherein application of an electric current to said wire winding causes said valve needle to move from said first position to said second position;

wherein said external threads of said inlet sleeve have a major diameter that is greater than said bobbin inside diameter.

8. A fuel injector as in claim 7, wherein said upper housing has a maximum external diameter which is less than or equal to said bobbin inside diameter.

9. A fuel injector as in claim 1, wherein:

said inlet sleeve extends axially from an upper-most end which is distal from said nozzle tip to lower-most end which is proximal to said nozzle tip; and said upper housing extends through said inlet sleeve such that said upper housing extends beyond said upper-most end of said inlet sleeve in a direction away from said nozzle tip.

10. A fuel injector as in claim 9, wherein said fuel injector further comprises a weld which fixes said inlet sleeve to said upper housing such that said weld is located at an intersection of said upper-most end of said inlet sleeve and a portion of said upper housing which extends beyond said upper-most end of said inlet sleeve in a direction away from said nozzle tip.

11. A fuel injector as in claim 1, wherein said inlet sleeve includes means for preventing rotation of said fuel injector when said nut is tightened to said fuel injector.

12. A fuel injector as in claim 11, wherein said means for preventing rotation of said fuel injector is located axially between said external threads and said nozzle tip.

13. A fuel injector as in claim 1, wherein said outer peripheral surface of said upper housing includes a retention groove extending thereinto such that said retention groove is annular in shape.

14. A fuel injector as in claim 13, wherein said retention groove includes:

an upper shoulder which is substantially perpendicular to said axis and which intersects with said outer peripheral surface and said inner peripheral surface; and a lower lead-in surface between located axially between said upper shoulder and said nozzle tip, said lower lead-in surface being inclined relative to said axis in range of about 10° to about 45° such that said lower lead-in surface diverges away from said axis in a direction away from said upper shoulder and said lower lead-in surface intersecting with said outer peripheral surface and said inner peripheral surface.

15. A fuel injector as in claim 2, wherein said outer peripheral surface of said upper housing which is frusto-conical mates with said inner peripheral surface of said inlet sleeve which is frustoconical.

16. A fuel injector as in claim 3, wherein:

said elastomeric O-ring is captured radially between said upper housing and said inlet sleeve;

said elastomeric O-ring is compressed radially inward by said inlet sleeve; and said elastomeric O-ring is compressed radially outward by said upper housing.

17. A fuel injector as in claim 1, wherein an inlet sleeve bore extends through said inlet sleeve along said axis such that said inlet sleeve bore defines said inner peripheral surface of said inlet sleeve.

18. A fuel injector as in claim 1, wherein said inlet sleeve is fixed to said upper housing, thereby preventing relative movement between said inlet sleeve and said upper housing when said external threads of said inlet sleeve are not mated with said complementary internal threads of said nut.

19. A fuel injector as in claim 1, wherein:

said upper housing extends from an upper-most extremity which is distal from said nozzle tip to a lower-most extremity which is proximal to said nozzle tip;

said upper housing includes an upper housing bore which extends from said upper-most extremity toward said lower-most extremity such that said upper housing bore serves as a fuel passage through which fuel flows from said upper-most extremity toward said lower-most extremity.

20. A fuel injector as in claim 1, wherein said external threads of said inlet sleeve are configured to mate with said complementary internal threads of said nut, thereby sealingly pressing said fuel supply conduit against said upper housing.

* * * * *